US010238905B2

(12) United States Patent
Kaye

(10) Patent No.: US 10,238,905 B2
(45) Date of Patent: Mar. 26, 2019

(54) LACROSSE TRAINING DEVICE

(71) Applicant: Christopher J. Kaye, Eastlake, OH (US)

(72) Inventor: Christopher J. Kaye, Eastlake, OH (US)

( * ) Notice: Subject to any disclaimer, the term of this patent is extended or adjusted under 35 U.S.C. 154(b) by 0 days.

(21) Appl. No.: 15/927,541

(22) Filed: Mar. 21, 2018

(65) Prior Publication Data

US 2018/0207465 A1 Jul. 26, 2018

Related U.S. Application Data

(60) Provisional application No. 62/247,862, filed on Oct. 29, 2015.

(51) Int. Cl.

| | |
|---|---|
| ***A63B 69/00*** | (2006.01) |
| ***A63B 15/00*** | (2006.01) |
| ***A63B 60/24*** | (2015.01) |
| *A63B 59/20* | (2015.01) |
| *A63B 102/14* | (2015.01) |
| *A63B 60/04* | (2015.01) |
| *A63B 21/008* | (2006.01) |

(52) U.S. Cl.

CPC ..... *A63B 15/005* (2013.01); *A63B 60/24* (2015.10); *A63B 21/0088* (2013.01); *A63B 59/20* (2015.10); *A63B 60/04* (2015.10); *A63B 69/00* (2013.01); *A63B 69/0002* (2013.01); *A63B 2069/0008* (2013.01); *A63B 2102/14* (2015.10); *A63B 2225/01* (2013.01)

(58) Field of Classification Search

CPC ..... A63B 15/005; A63B 69/0002; A63B 2069/0008; A63B 60/04; A63B 2102/14

USPC ..... 473/437, 457, 446, 519, 513

See application file for complete search history.

(56) References Cited

U.S. PATENT DOCUMENTS

| | | | | | |
|---|---|---|---|---|---|
| 4,027,886 | A * | 6/1977 | Katsube | A63B 69/3632 | 273/456 |
| 4,809,975 | A * | 3/1989 | Lee | A63B 15/005 | 473/256 |
| 5,330,190 | A * | 7/1994 | Oakley, Jr. | A63B 15/005 | 473/234 |
| 5,360,209 | A * | 11/1994 | Mollica | A63B 15/005 | 473/457 |
| 5,474,511 | A * | 12/1995 | Dantolan | A63B 21/05 | 482/93 |
| 5,711,718 | A * | 1/1998 | Mueller | A63B 15/005 | 473/234 |
| 6,955,610 | B1 * | 10/2005 | Czaja | A63B 15/005 | 473/256 |

(Continued)

*Primary Examiner* — Mark S Graham
(74) *Attorney, Agent, or Firm* — John D. Gugliotta

(57) ABSTRACT

A sports training apparatus for practicing lacrosse comprising an elongate rigid member extending along a length between first and second ends, first and second stops secured to the elongate rigid member, and a slidable mass on the elongate rigid member, slidable along the elongate rigid member between the first and second stops. A kit for retrofitting a lacrosse stick for practicing lacrosse comprising first and second stops, securable to a lacrosse stick; and a slidable mass, having a passage along an axis there through. The instant abstract is neither intended to define the invention disclosed in this specification nor intended to limit the scope of the invention in any way.

20 Claims, 6 Drawing Sheets

(56) References Cited

U.S. PATENT DOCUMENTS

| | | | | |
|---|---|---|---|---|
| 7,297,078 | B2 * | 11/2007 | Libonati | A63B 15/005 473/457 |
| 8,118,693 | B2 * | 2/2012 | Tande | A63B 15/005 473/457 |
| 8,540,584 | B1 * | 9/2013 | Sorenson | A63B 69/36 473/256 |
| 9,833,676 | B2 * | 12/2017 | Smith, Jr. | A63B 69/0002 |
| 9,943,740 | B2 * | 4/2018 | Mayers, III | A63B 69/0002 |
| 2004/0048696 | A1 * | 3/2004 | Ciesar | A63B 69/0002 473/457 |
| 2004/0176194 | A1 * | 9/2004 | Mitchell | A63B 21/0608 473/437 |
| 2007/0155525 | A1 * | 7/2007 | Davenport | A63B 15/005 473/256 |
| 2010/0285907 | A1 * | 11/2010 | Deschesnes | A63B 15/00 473/437 |

* cited by examiner

LACROSSE TRAINING DEVICE

RELATED APPLICATIONS

The present invention claims benefit of U.S. Provisional Application No. 62/247862 filed on Mar. 22, 2017, and incorporated by reference as if fully rewritten herein.

BACKGROUND OF THE INVENTION

1. Field of the Invention

The present invention relates generally to a sports training apparatus and, more particularly, to a training device that aids in developing the proper throwing motions and improved exit velocity for the sport of lacrosse.

2. Description of the Related Art

Lacrosse is a sport that utilizes a stick that features a head and net on the end of a shaft which is used for passing, catching and shooting a hard rubber ball. Accurate control and shot touch and velocity are critical skills to master for success.

Passing and especially shooting, often requires the release point and the stick trajectory be generated from a variety of positions and angles. Since there is a goalie and defensive players trying to cut off shooting angles and initiating other defensive means to prevent the ball from entering the goal, the shot velocity also greatly influences shooting success.

It is thus an object of the present invention to provide a lacrosse training device.

It is another object of the present invention to provide such a device to allow a user to practice shooting, and especially full-speed snap-off shots.

It is a further object of the present invention to allow for the full-speed practice of a lacrosse shot in a useful manner but without the discharging of a lacrosse ball or other projectile.

Further objects and advantages of the invention will become apparent in the course of the following description of the invention.

SUMMARY OF THE INVENTION

According to a first embodiment of the present invention there is disclosed a sports training apparatus comprising an elongate rigid member extending along a length between first and second ends, first and second stops secured to the elongate rigid member, and a sizeable mass on the elongate rigid member between the first and second stops.

The elongate rigid member may be substantially straight. The elongate rigid member may include a curved portion between the first and second stops. The first and second stops may be removable. The first and second stops may be adjustably located on the elongate rigid member. The second stop may be secured proximate to the second end, wherein the first stop may be secured between the first and second ends.

The slidable mass may have a weight and a center of gravity selected to replicate a lacrosse ball. The sizeable mass may be replaceable. The slidable mass may have a weight selected to be greater than a lacrosse ball. The slidable mass may include a gyroscope therein. The slidable mass may include protrusions, shaped and sized to provide wind resistance, extending therefrom.

The apparatus may further comprise sensors adapted to measure the path and speed of the elongate rigid member. The apparatus may further comprise source indicators adapted to provide feedback to the user in response to signals from said sensors representing the user's movement during operation. The source indicators may be selected from a group consisting of lights, lasers, radio transmitters, ultrasonic transmitters, infrared transmitters and vibrating indicators. The source indicators may be activated in response to the relative position of the sliding mass along the elongate rigid member. The source indicators may be activated in response to contact between the sliding mass and the second stop. The sensors may be located at a target location distal from the source indicators.

The apparatus may further comprise target indicators. The target indicators may be selected from a group consisting of light and sound indicators.

The target indicators may be selectively activated by the sensors receiving input from the source indicators.

According to a further embodiment of the present invention there is disclosed a kit for retrofitting a lacrosse stick for practicing lacrosse comprising first and second stops, securable to a lacrosse stick; and a slidable mass having a passage along an axis there through.

The slidable mass may be receivable on the lacrosse stick through the passage.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

These listed variations are provided for purposes of disclosing known variations of the best mode for carrying out the invention is presented; however, the order of presentation is not intended to imply a preference in terms of the inventions preferred embodiment but are provided for purposed of broadly disclosing the present innovation. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

DESCRIPTION OF THE PREFERRED EMBODIMENTS

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
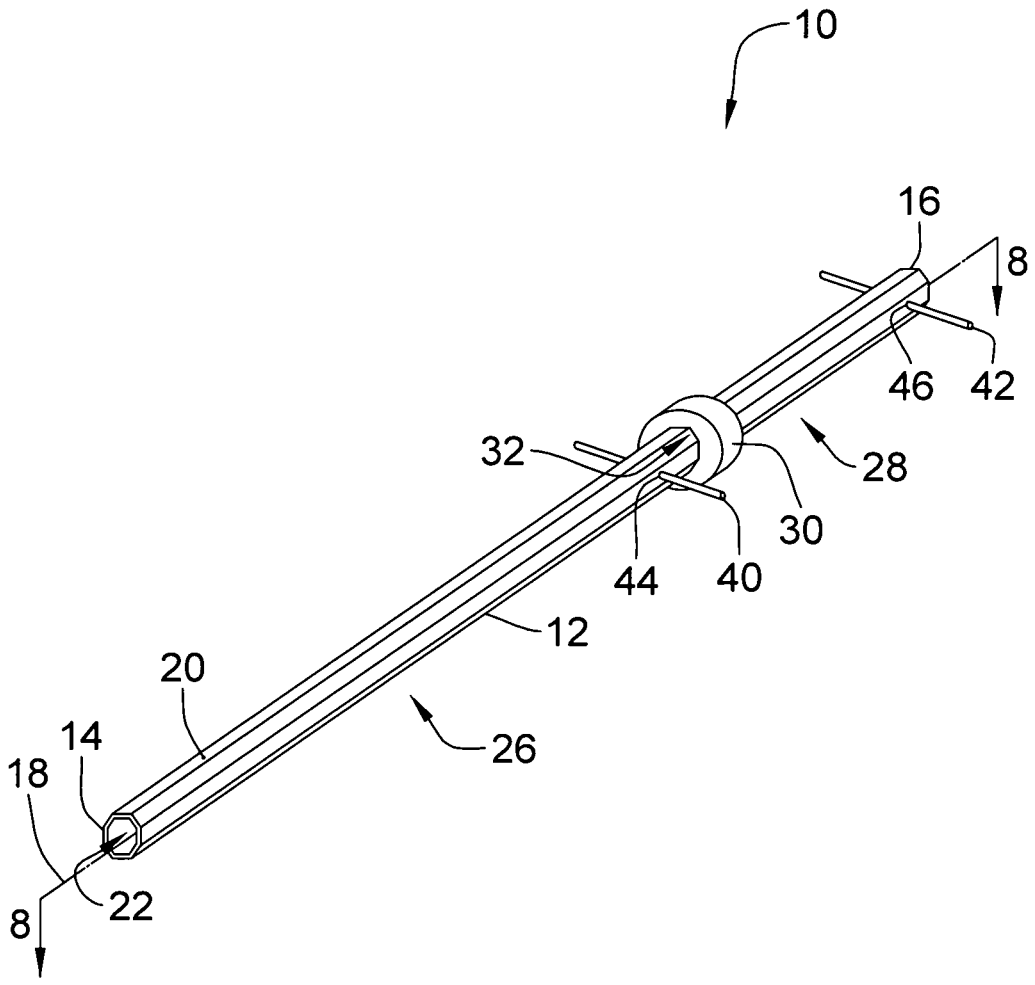
FIG. 1 is a is a perspective view of sports training apparatus for practicing lacrosse according to a first embodiment of the present invention.

Referring to FIG. 1, a sports training apparatus for practicing lacrosse according to a first embodiment of the invention is shown generally at 10. The apparatus 10 comprises an elongate shaft 12 with a slidable mass 30 thereon, restricted along a lengthwise axis 18 between first and second stops, 40 and 42, respectively.

The elongate shaft 12 extends between first and second ends, 14 and 16, respectively, along the axis 18, and has an outside surface 20. The elongate shaft 12 comprises a grip portion 26 and a slide portion 28. The grip portion 26 is defined between the first end 14 and the first stop 40. The slide portion 28 is defined between the first and second stops, 40 and 42. The elongate shaft 12 may have an octagonal cross-section, as illustrated in FIG. 1, similar to a standard lacrosse stick, although other cross-sections, such as, by way of non-limiting example, round or oval, may be useful, as well. The elongate shaft 12 may be hollow, as illustrated in FIG. 1, with a central passage 22 there through along the axis 18, although it will be appreciated that the elongate shaft 12 may 30 be solid, as well. The elongate shaft 12 may be formed using such as, by way of non-limiting example, aluminum or other metals, reinforced polymer such as graphite, wood or other suitable rigid materials. Although the elongate shaft 12 is illustrated as a fixed length shaft, it will be appreciated that the elongate shaft 12 could have an adjustable length option with the addition of a second elongate shaft adapted to fit within the central passage 22 and slide therein along the axis 18, with a threaded collar or the like, as is commonly known, to lock the second elongate shaft in place at the desired length.

The slidable mass 30 includes a central passage 32 there through with a size and profile shape selected to allow the slidable mass 30 to slide freely along the axis 18 on the slide portion 28 of the elongate shaft 12. The slidable mass 30 may be formed in one piece, as illustrated, or it may be formed in a plurality of pieces secured together around the elongate shaft 12, and subsequently detached therefrom for exchange with another slidable mass 30. The slidable mass 30 may be formed using such as, by way of non-limiting example, polymer, rubber, wood or any other material to simulate the weight of a lacrosse ball, or may be selected to be a greater mass, so as to build a user's strength.

Figure 10:
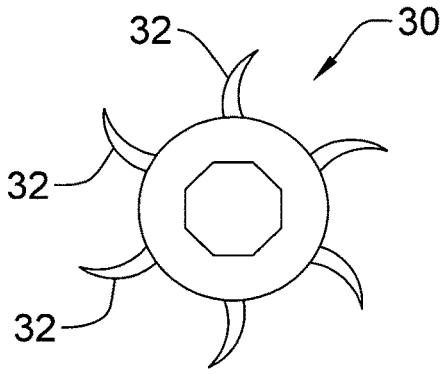
FIG. 10 is a top plan view of a further embodiment sizeable mass.

The slidable mass 30 may include a gyroscope or other device to produce a torque therein, to aid in the development of control, strength and muscle memory of a user. The slidable mass 30 may include protrusions extending therefrom, shaped and sized to provide wind resistance, as is commonly known. The addition of wind resistance aids in the development of user control, strength and muscle memory. As illustrated in FIG. 10, the wind resistance aids may comprise a plurality of longitudinal fins 34, as are commonly known. Alternately, the slidable mass 30 may be adapted to be located within the central passage 22 of the elongate shaft 12, between the first and second stops, 40 and 42, respectively, and slidable therein.

Figure 3:
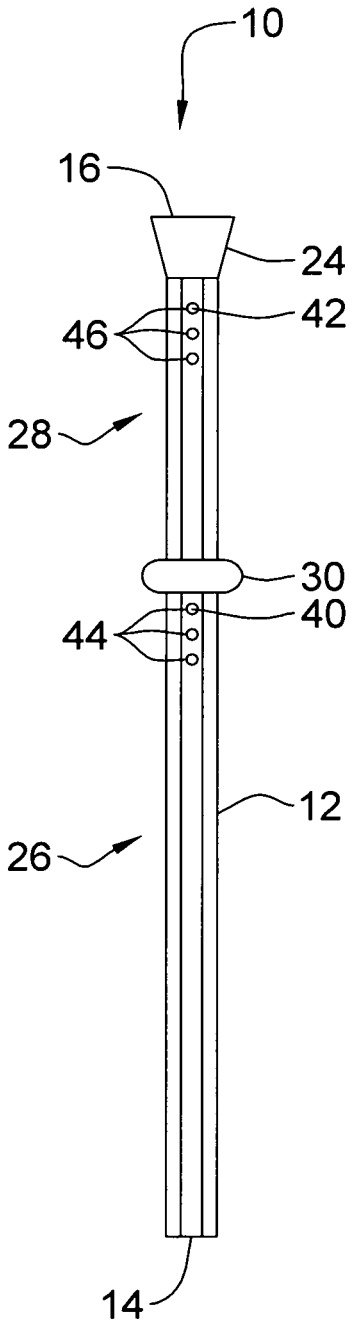
FIG. 3 is a side elevation view of the apparatus of FIG. 2.

First and second stop bores, 44 and 46, respectively, pass through the elongate shaft 12 perpendicular to the axis 18. The first stop 40 is positioned between the first and second ends, 14 and 16, as illustrated. The second stop 42 is positioned proximate to the second end 16. The first and second stops, 40 and 42, may be formed as rods or pins, as illustrated, which pass through the first and second stop bores, 44 and 46, such that they extend beyond the outside surface 20 and therefore prevent the slidable mass 30 from sliding there beyond. As illustrated in FIG. 3, there may be multiple first or second stop bores, 44 and 46, such that the first and second stop locations are adjustable, dependent on a user's needs. Adjusting the locations of the first and second stops, 40 and 42, allows for adjustment of the length of the slide portion 28.

The first and second stops, 40 and 42, may include cotter pins, as are commonly known, to allow for selective removal, or they may be secured to the elongate shaft 12 by any means as is commonly known in the art. By removing the second stop 42, a sizeable mass 30 formed in one piece may be removed from the elongate shaft 12 and replaced with an alternate slidable mass 30, with a selected desired weight. It will be appreciated that a slidable mass 30 formed in a plurality of pieces may be removed from the elongate shaft without the need to remove the second stop 42.

The first and second stops 40 and 42 may also be permanently secured to the elongate shaft 12 by any known means. Although the first and second stops 40 and 42 are illustrated as rods or pins, it w ill be appreciated that other stop methods may be useful, as well, including a collar or clamp located on the elongate shaft 12 selected to be larger than the central passage 32 of the slidable mass 30.

To use the apparatus 10, a user grasps the grip portion 26 in the same manner as a lacrosse stick is held, as is commonly known. Due to gravity, the slidable mass 30 will be engaged upon the first stop 40 on the slide portion. As the user practices the motion of throwing a ball, the sizeable mass 30 slides up the shaft 18 towards the second stop 42. A successful motion will result in the slidable mass 30 engaging upon the second stop 42. As the sizeable mass 30 engages upon the second stop 42 it will produce both audible and tactile feedback to the user due to the impact thereon. In the case of an incorrect motion, the slidable mass 30 will produce little to no impact upon the second stop 42, thereby reducing the intensity of the feedback and indicating an unsuccessful shot.

Figure 2:
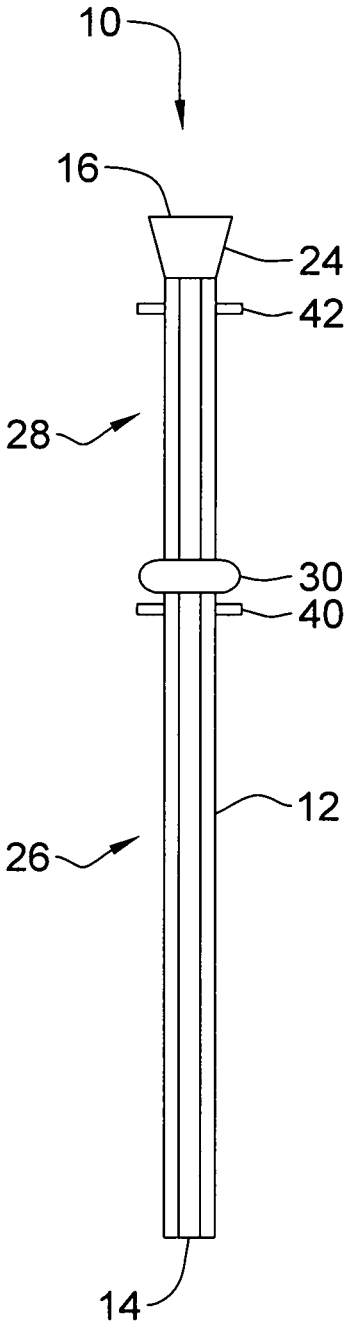
FIG. 2 is a front elevation view of the apparatus of FIG. 1 according to a further embodiment of the present invention.

Turning now to FIGS. 2 and 3, a further embodiment of the present invention is illustrated with an expanded portion 24 at the second end 16. The expanded portion 24 is selected such that the sizeable mass 30 may not pass there over, increasing the safety of the device.

Figure 4:
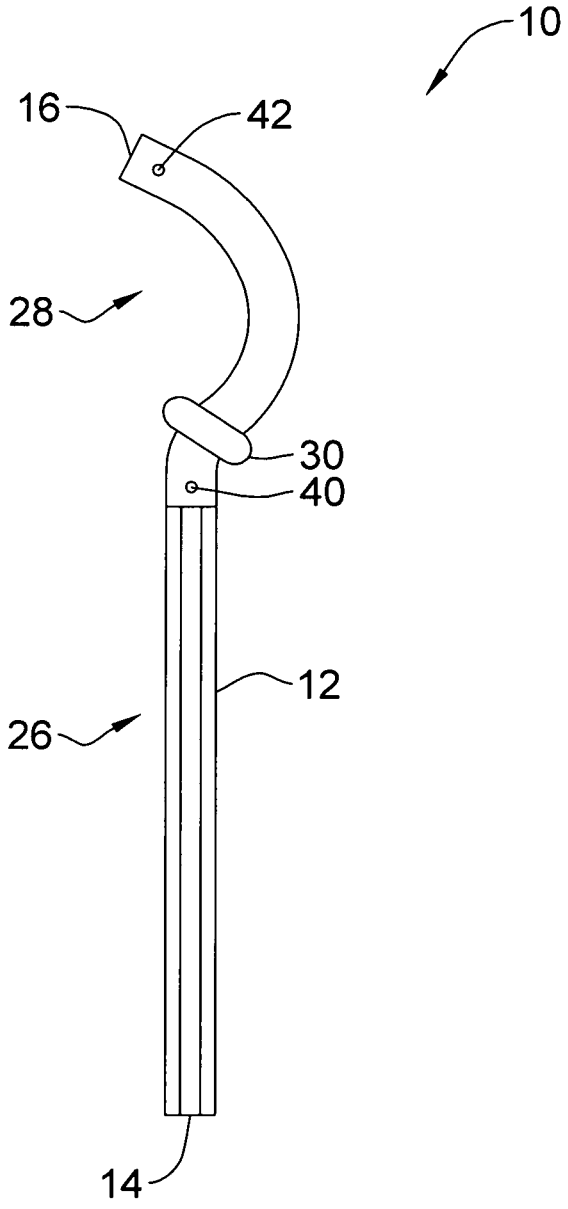
FIG. 4 is a side elevation view of the apparatus of FIG. 1 according to a further embodiment of the present invention.

FIG. 4 illustrates a further embodiment of the present invention wherein the slide portion 28 of the elongate shaft 12 is curved. The curved slide portion 28 may be utilized to better replicate the motion required when a lacrosse ball is within a deep pocket prior to shot release, as is more common with men's, boy's or goalie's sticks.

Figure 5A:
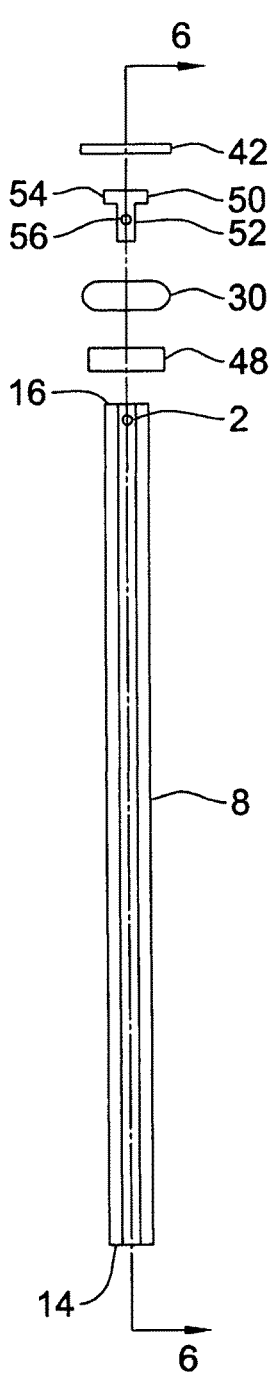
FIG. 5*a* is a front elevational exploded view of a retrofit lacrosse stick sports training apparatus kit according to a further embodiment of the present invention.
Figure 6A:
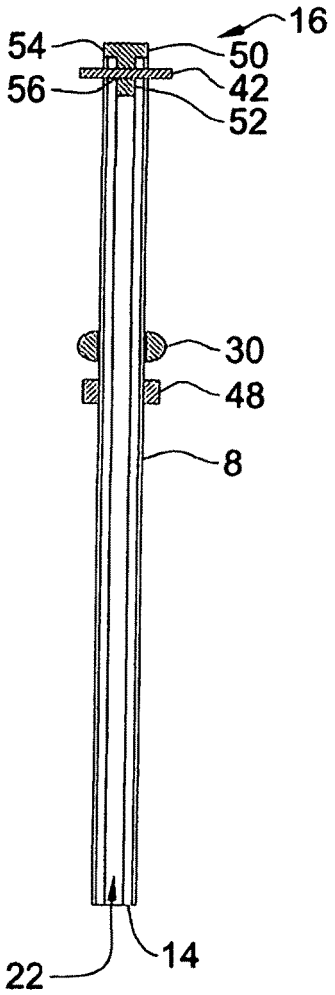
FIG. 6*a* is a cross-sectional view of the retrofit apparatus of Figure 5*a* along the line 6-6.

Turning now to FIGS. 5*a* and 6*a*, a standard lacrosse stick with an elongate shaft 8 and head 6 may be retrofitted to form a sports training apparatus 10. All screws or attachment stops 4 are removed from the attachment holes 2 such 15 that the head 6 may be detached from the elongate shaft 8. A first stop clamp 48 is used in place of the first stop 40. The first stop clamp 48 is selected such that the elongate shaft 8 may pass there through, and the first stop clamp 48 may be secured, as is commonly known, at a desired location. The slidable mass 30 is positioned on the elongate shaft 8 following the first stop clamp 48. It should be noted that the player's top hand could be used to position the sliding mass, alleviating the need for stop 48.

Figure 5B:
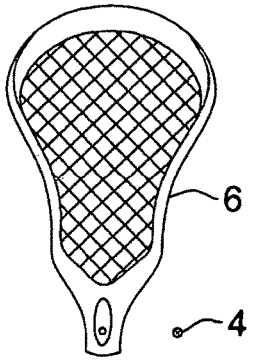
FIG. 5*b* is a is a cross sectional view of the retrofit apparatus of the haft as in FIG. 5*a* according to an alternate configuration having the sliding mass inside the hollow shaft.
Figure 5B:
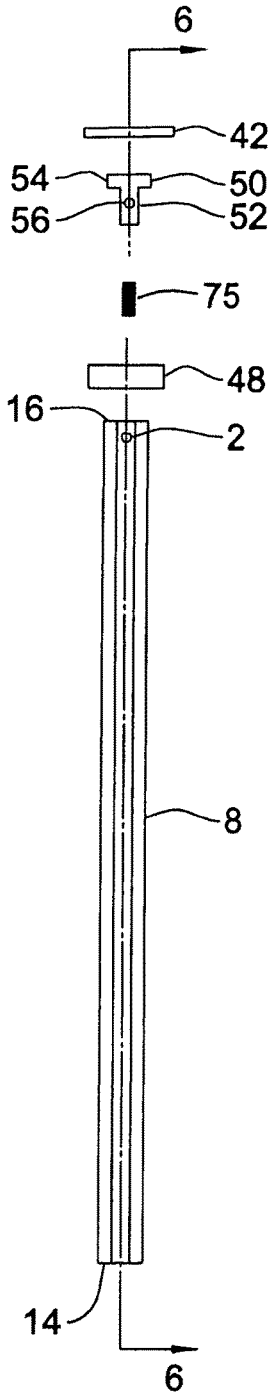
Figure 6B:
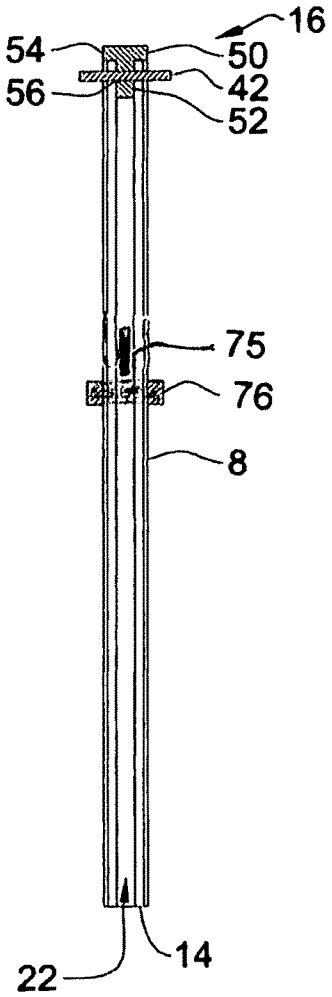
FIG. 6*b* is a cross sectional view of the retrofit apparatus of a shaft as in FIG. 5*b* according to an alternate configuration having the sliding mass inside the hollow shaft.

As illustrated in FIG. 6*a*, the elongate shaft 8 includes a central passage 22 similar to the central passage 22 of the elongate shaft 12 illustrated in FIG. 1. As illustrated in FIG. 5*b* and FIG. 6*b*, an alternate configuration for the elongate shaft 8 includes the slidable mass 75 contained within the central passage 22. The alternate position for the mass 75 is shown herein inside the shafts to previous FIGS. 5 and 6)

A support plug 50 includes an inside plug portion 52 and an outside portion 54.

The inside plug portion 52 includes a stopping bore 56 there through. The inside plug portion 52 is selected to be received within the central passage 22 at the second end 16 of the elongate shaft 8. The outside portion 54 is selected to be larger than the central passage 22 so as to help ensure the stopping bore 56 may be positioned in alignment with the attachment holes 2. It will be appreciated that other alignment or attachment techniques could be employed, as are commonly known. The second stop 42 is received through the aligned attachment holes 2 and stopping bore 56, securing the support plug 50 to the elongate shaft 8 and retaining the sizeable mass 30 on the elongate shaft 8.

Although the second stop 42 is illustrated as passing through the attachment holes 2 and stopping bore 56, it will be appreciated that the screws or attachment stops 4 may be used to attach the support plug 50 to the elongate shaft 8, and the outside portion 54 may be sized as a second stop.

Figure 7:
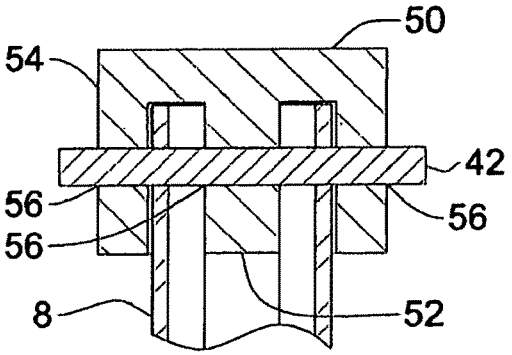
FIG. 7 is a further embodiment of a support plug for a retrofit apparatus.

FIG. 7 illustrates a further embodiment of the support plug 50. In this embodiment, the outside portion 54 extends along the outside of the elongate shaft 8 with aligned stopping bores 56 extending through the outside portion 54 as well as through the inside portion 52. The second stop 42 then passes through the outside portion 54, the attachment holes 2 and the inside portion 52.

Figure 8:
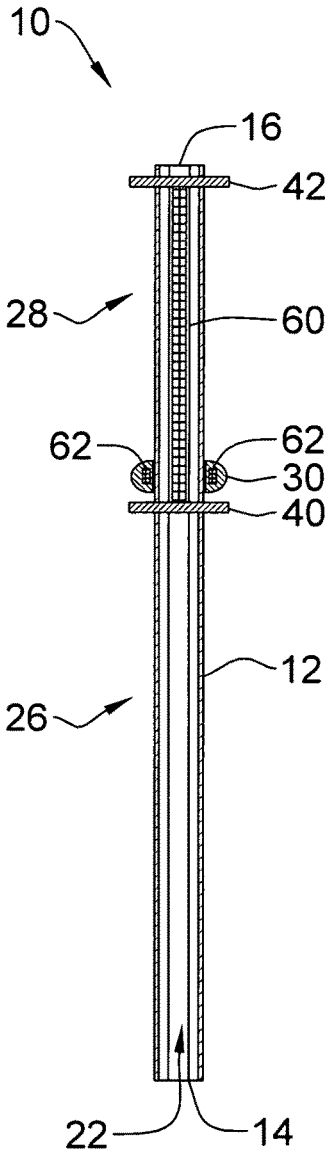
FIG. 8 is a cross-sectional view of the apparatus of FIG. 1 along the line 8-8 according to a further embodiment of the present invention.

Turning now to FIG. 8, the apparatus 10 may include shaft and slider sensors, 60 and 62, respectively, to provide aim and target feedback to the user. The shaft sensors 60 may be located within the central passage 22 of the slide portion 28, while the slider sensors may be incorporated within the slidable mass 30. Additional sensors (not shown) may be included within the second stop 42. An indicator may be included, as well, to provide audio, visual or tactile feedback from the sensors. The indicator may be configured to receive input from the sensors so as to produce, such as, by way of non-limiting example, a chime for proper velocity and position of the slidable mass 30, or a buzz for an incorrect position, indicating a ball falling out of the pocket during real play, or vibrations.

Figure 9:
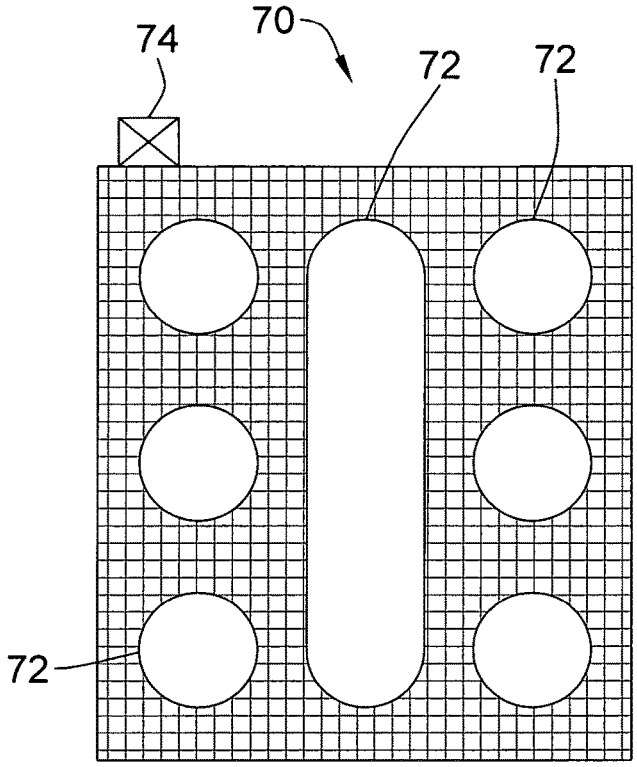
FIG. 9 is a front elevation view of a target apparatus for use with the further embodiment apparatus of FIG. 8.

FIG. 9 illustrates a target 70 which may be used in conjunction with an apparatus 10 including sensors, as described above. The target 70 includes a plurality of target sensors 72 and a target indicator 74. The target indicator 74 may be such as, by way of non-limiting example, an audio or visual indicator. A transmitter on the apparatus 10 sends a signal which may be converted to a projected trajectory of the ball and received by the target sensors 72.

Dependent on where the ball would be received on the target 70 by the projected trajectory, the target indicator 74 would produce a selected indication.

A sound or light may indicate the estimated resultant location of the ball on the target 70.

2. Operation of the Preferred Embodiment

A challenge with team sports is that it can be difficult to hone skills independently, but a significant training advantage of this invention is the ability to practice without partner(s). The player can practice independently, even in a confined area and develop different shot angles and throwing motions that result in better performance. The proprioception and kinesthetic effects (fast twitch muscles and muscle memory) that are developed by repetition of key motions and full-speed practice cannot be underestimated.

A key feature of the invention is the ability of the player to establish the kinesthetic sense for stick motion for ball control and shooting. This muscle memory will be reinforced as the player understands the proper movement(s) that generate velocity without sacrificing control.

Another advantage of the invention is for pre-game warm-ups. Although stretching, pass/catch lines, and other drills can be performed, it is usually not practical for players to attempt hard, full-speed shots prior to the game. The players, therefore, cannot snap off shots and get loose and fully prepared from a shooting perspective for the game using their standard equipment. Choices are then limited to the passing and catching drills or swinging full-speed with an empty stick. The training stick is far superior in this regard since it allows the player to simulate shots at full speed with a stick that better simulates actual shots when there is a ball in the pocket. This translates into an advantage since the player can be ready to compete at full speed from the start of the game.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A sports training apparatus for practicing lacrosse comprising:

an elongate shaft formed of a rigid member extending along a length between a gripping portion at a proximal end and a slide portion at a distal end;

a first stop adjustably secured to said shaft, said first stop is selectively removable from said shaft;

a second stop adjustably secured to said shaft at or near the distal end, said second stop is selectively removable from said shaft;

a slidable mass on said shaft between said first stop and said second stop, wherein said slidable mass has a weight at least as much as a lacrosse ball;

a plurality of first bores at different locations laterally along said rigid member and each formed laterally through the elongate shaft perpendicular to an elongated axis of said rigid member;

a plurality of second bores at different locations laterally along said rigid member and each formed laterally through the elongate shaft perpendicular to the elongated axis of said rigid member;

said first stop forming a rod or pin passing through at least one pair of said plurality of first bores; and said second stop forming a rod or pin passing through at least one pair of said plurality of second bores.

2. The sports training apparatus of claim 1 wherein said second stop is secured proximate to said distal end, wherein said first stop is secured between said proximal and distal ends.

3. The sports training apparatus of claim 1 further comprising at least one sensor placed along said shaft adapted to measure the path and speed of the rigid member.

4. The sports training apparatus of claim 3 further comprising source indicators adapted to provide feedback to the user in response to signals from said at least one sensor representing the user's movement during operation.

5. The sports training apparatus of claim 4 wherein said source indicators are selected from a group consisting of: lights; lasers; radio transmitters; ultrasonic transmitters; infrared transmitters and vibrating indicators.

6. The sports training apparatus of claim 5 wherein said source indicators are activated in response to the relative position of said sliding mass along said rigid member.

7. The sports training apparatus of claim 6 wherein said source indicators are activated in response to contact between said sliding mass and said second stop.

8. The sports training apparatus of claim 7 wherein said at least one sensor is located at a target location distal from said source indicators.

9. The sports training apparatus of claim 8 further comprising at least one target indicator.

10. The sports training apparatus of claim 9 wherein said at least one indicator is selected from a group consisting of light indicators and sound indicators.

11. The sports training apparatus of claim 10 wherein said at least one indicator is selectively activated by said sensors receiving input from said source indicators.

12. The sports training apparatus of claim 1, wherein said slide portion of the shaft forms a curved element between said first stop and said second stop.

13. The sport training apparatus of claim 1, wherein said elongate shaft is formed of a lacrosse stick.

14. The sport training apparatus of claim 13, further comprising a training kit comprising said second stop for securing to said lacrosse stick at or near a distal end;

said first stop is located proximal to said first stop and for securing to said lacrosse stick; and said slidable mass adapted for placement on said lacrosse stick.

15. The sports training apparatus of claim 1, wherein the slidable mass has a weight greater than the lacrosse ball and/or typical lacrosse head.

16. The sports training apparatus of claim 1, comprising slidable masses can be of varying weight and/or center of gravity which changed according to user preference.

17. The sports training apparatus of claim 1, wherein at least said first stop is adjustably secured at different locations laterally along said rigid member.

18. The sports training apparatus of claim 16, wherein at least said second stop is adjustably secured at different locations laterally along said rigid member.

19. sports training apparatus for practicing lacrosse comprising:

an elongate shaft formed of a rigid member extending along a length between a gripping portion at a proximal end and a slide portion at a distal end;

a first stop adjustably secured to said shaft, said first stop is selectively removable from said shaft;

a second stop adjustably secured to said shaft at or near the distal end, said second stop is selectively removable from said shaft;

a slidable or fixed mass on said shaft between said first stop and said second stop, wherein said slidable or fixed mass has a weight at least as much as a lacrosse ball, wherein said slidable or fixed mass includes a gyroscope therein.

20. A sports training apparatus of claim 19 wherein said slidable mass includes protrusions, shaped and sized to provide wind resistance, extending therefrom.

* * * * *